US005463495A

United States Patent [19]

Murg

[11] Patent Number: 5,463,495

[45] Date of Patent: Oct. 31, 1995

[54] AIMING TELESCOPE

[75] Inventor: Erwin Murg, Neu-Rum, Austria

[73] Assignee: Swarovski Optik KG, Absam, Austria

[21] Appl. No.: 245,420

[22] Filed: May 18, 1994

[30] Foreign Application Priority Data

Nov. 18, 1993 [DE] Germany ..... 43 39 397.7

[51] Int. Cl.[6] ..... G02B 23/10; F41G 1/38

[52] U.S. Cl. ..... 359/429; 359/399; 359/428; 33/246

[58] Field of Search ..... 359/399, 417–429, 359/811–819, 827, 506; 33/246–250, 298; 42/101, 103; 356/247–252; 362/110, 196, 204

[56] References Cited

U.S. PATENT DOCUMENTS 2,627,659 2/1953 Murr ..... 33/298
2,955,512 10/1960 Kollmorgen et al. ..... 33/246
4,998,811 3/1991 Basta ..... 359/422

FOREIGN PATENT DOCUMENTS 389003 10/1985 Austria .
3208814C2 9/1983 Germany .
249546 9/1987 Germany ..... 359/428

OTHER PUBLICATIONS

English abstract of the reference AT 389,003.
English abstract of the reference DE 32 08 814.

*Primary Examiner*—Thong Q. Nguyen
*Attorney, Agent, or Firm*—Fish & Richardson

[57] ABSTRACT

An aiming telescope has an inner tube mounted within the main tube on the eyepiece side, e.g. with a ball-and-socket joint, for receiving an inversion system and a reticle. For adjusting the reticle, a pair of adjusting spindles disposed at right angles to each other are provided, the restoring forces being applied by a spring which is supported on the ball of the ball-and-socket joint at a distance from the center of the ball, on the one hand, and on the main tube, on the other hand.

10 Claims, 1 Drawing Sheet

AIMING TELESCOPE

BACKGROUND

The present invention relates to an aiming telescope having a main tube with eyepiece and objective in which an inner tube is mounted with a joint on the eyepiece side for receiving an inversion system and a reticle, a pair of adjusting spindles disposed on the main tube at an angle to each other and acting on the inner tube at a distance from the joint, and at least one spring for urging the inner tube against the adjusting spindles.

Such aiming telescopes are known. They permit the reticle to be moved relative to the weapon so that it can be brought into agreement with the meeting point. Since reticle and inversion system are shifted jointly relative to the target imaged by the objective the reticle remains in the center of the visual field, regardless of the necessary adjusting motion (centered reticle). The adjusting motion is started by the pair of adjusting spindles disposed at right angles to each other. To produce the necessary restoring force one normally uses one or two springs disposed between the main tube and the inner tube at a distance from the joint, i.e. acting perpendicular to the inner tube axis.

The springs disposed between the inner tube and the main tube restrict the adjusting distance so that the adjusting distance may be too short if the aiming telescope is not properly mounted on the weapon. For reasons of space the spring size is also small compared to the relatively large adjusting distances, resulting in great variations in spring force over the adjusting distance. Furthermore, a relative motion occurs between spring and main tube or inner tube, leading to frictional losses and at the same time to a danger of the optical system being soiled by abrasion. In addition, the inner tube can only be assembled with a prestressed spring, which increases the assembly effort.

SUMMARY

The invention is therefore based on the problem of providing an easily assembled aiming telescope which has a large adjusting distance and eliminates the danger of the optical system being soiled by abrasion.

This is obtained according to the invention by an aiming telescope of the abovementioned type wherein the spring or springs are supported at a distance from the center of the joint on the joint portion fixed on the inner tube, on the one hand, and on the main tube, on the other hand.

Supporting the spring or springs at a distance from the center of the joint on the joint portion fixed on the inner tube obtains the necessary torque about the center of the joint.

The force of the spring or springs is preferably aligned parallel to the inner tube axis. This utilizes the spring force completely, i.e. obtains the highest torque. The spring or springs can be formed as compression or tension springs. In case of more than one spring one can use both compression springs and tension springs.

The joint is formed by a joint with two degrees of freedom. That is, it may be a ball-and-socket joint, but other joint designs are also possible; e.g. an elastic joint whereby the inner tube is mounted within the main tube for example via one or two spaced rings made of rubber or a gum elastic material. With a ball-and-socket joint the joint portion fixed on the inner tube is formed by the ball, while with an elastic joint it consists e.g. of a ring land or other projections on the inner tube disposed e.g. on or between the rubber rings.

With the inventive aiming telescope there is relatively a lot of room in the area of the reticle and the optics of the inversion system. This results in a large adjusting distance. This room can also be utilized to give the optical components, e.g. the field lens or reticle, a larger design and thus improve the optical performance.

To obtain high precision and firing stability the joint must be mounted free from play, which requires considerable time with the conventional aiming telescope. By contrast, in the inventive aiming telescope the clearance of motion of the joint is eliminated by the springs acting on the joint portion fixed on the inner tube. This substantially reduces the time required for adjusting play during assembly and at the same time considerably improves the resistance of the inversion system to shock stress during firing.

Since the springs are only installed after the inner tube with the inversion system is inserted into the main tube the assembly of the inversion system is not impeded by prestressed springs. At the same time one can use amply dimensioned coil springs according to the invention which have a functionally favorable characteristic. Since no relative motions occur between the spring and the inversion system or the main tube no abrasion arises in the inventive telescope which could lead to the optical system being soiled.

In the following an embodiment of the inventive aiming telescope will be explained in more detail with reference to the following description.

DESCRIPTION

Figure 1:
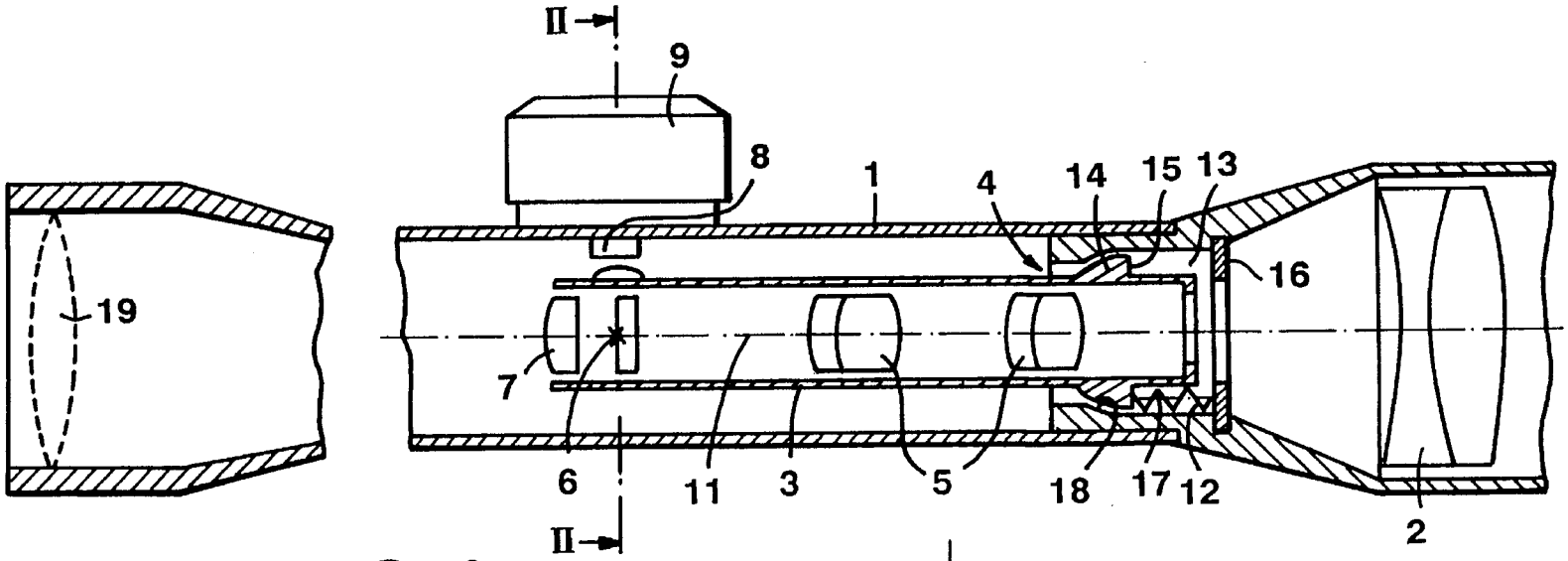
FIG. 1 shows a longitudinal section through an aiming telescope of the invention.
Figure 2:
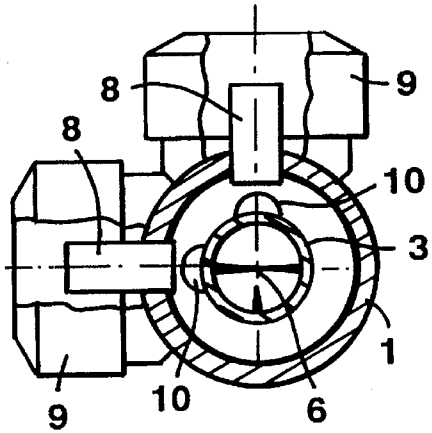
FIG. 2 shows a section along line II—II in FIG. 1.

The aiming telescope has main tube 1 within which eyepiece 2 is seated at one end and the objective 19 at the other, front end not shown.

Mounted within main tube 1 is inner tube 3 with ball-and-socket joint 4 which is disposed at the back end of inner tube 3 on the eyepiece side.

Inner tube 3 contains inversion system 5 formed by two lenses and in front of it a reticle 6 formed e.g. as cross-lines. At the front end of inner tube 3 is a field lens 7.

For adjusting reticle 6, i.e. bringing it into agreement with the meeting point, inner tube 3 is swiveled about ball-and-socket joint 4 with respect to main tube 1 fastened to the weapon. For this purpose a pair of adjusting spindles 8 extend perpendicular to each other through main tube 1 at a distance from ball-and-socket joint 4, each provided with turning knob 9. The other end of adjusting spindle 8 acts on spherical bump 10 on inner tube 3. Spherical bump 10 ensures a point contact of adjusting spindle 8 on inner tube 3 in every angular position of longitudinal axis 11 of the inner tube relative to the longitudinal axis of main tube 1.

The restoring forces are applied by coil spring 12 which loads inner tube 3 against adjusting spindles 8.

Coil spring 12 engages at one end recess 13 facing eyepiece 2 on ball 14 of ball-and-socket joint 4 forming the joint portion fixed on the inner tube. Recess 13 has end wall 15 extending radially to the center of the joint, i.e. to the center of the ball, and perpendicular to longitudinal axis 11 of the inner tube. End wall 15 supports one end of coil spring 12, i.e. at a distance from the center of ball 14 and thus from longitudinal axis 11 of the inner tube which is greater than the outside diameter of the inner tube. The other end of spring 12 acts on annular projection 16 mounted on main tube 1 on the side of ball 14 facing eyepiece 2. Projection 16 can be formed by a threaded or snap ring which engages a corresponding thread or groove on the inner wall of main tube 1. Axis 17 of coil spring 12, i.e. its force, extends substantially parallel to inner tube axis 11.

FIG. 1 shows only one spring 12. However one normally provides several, e.g. three, circumferentially distributed springs 12 between end wall 15 and annular projection 16.

For assembly the inner tube provided with inversion system 5, reticle 6 and field lens 7 is inserted into main tube 1 from the eyepiece side until ball 14 of ball-and-socket joint 4 hits socket 18 which extends toward the front from end wall 15 of ball 14. Springs 12 are then introduced and inner tube 3 and springs 12 fixed with the ring with projection 16.

What is claimed is:

1. An aiming telescope having a main tube with an eyepiece and an objective, an inner tube defining a longitudinal center axis and an outer diameter and being mounted within said main tube and having a first end extending toward said eyepiece and a second end extending toward said objective, said maid tube and said inner tube being engaged at a joint having a first joint portion fixed on said inner tube adjacent said first end of said inner tube and an opposed second joint portion fixed to said main tube said inner tube comprising an inversion system and a reticle, a pair of adjusting spindles disposed on said main tube at an angle to each other and acting on said inner tube at a distance from said joint toward said second end of said inner tube, and at least one spring for loading said inner tube against said adjusting spindles, said at least one spring defining a longitudinal axis and being supported at a distance from said center axis of said inner tube, between said first joint portion fixed on said inner tube and said main tube so that the axis of said spring does not coincide with the axis of said inner tube.

2. The aiming telescope of claim 1 wherein force applied by said at least one spring between said first joint portion fixed on said inner tube and said main tube is aligned substantially parallel to said center axis of said inner tube.

3. The aiming telescope of claim 1 or 2 wherein a first end of said at least one spring is supported on an end wall of said first joint portion fixed on said inner tube, said end wall extending radially from and perpendicular to said Center axis of said inner tube.

4. The aiming telescope of claim 1 or 2 wherein a first end of said at least one spring is disposed on said first joint portion fixed on said inner tube and an opposite, second end of said at least one spring extends toward said eyepiece.

5. The aiming telescope of claim 4 wherein said main tube comprising a fixed projection, said opposite, second end of said at least one spring is supported on said fixed projection fixed to said main tube.

6. The aiming telescope of claim 1 wherein said spring has an outer diameter that is substantially smaller than the outer diameter of said inner tube.

7. The aiming telescope of claim 1 wherein said joint is centrally disposed within said main tube.

8. The aiming telescope of claim 1 wherein said joint has two degrees of freedom.

9. The aiming telescope of claim 8 wherein said joint is a ball-and-socket joint.

10. The aiming telescope of claim 1 wherein said joint is located in the vicinity of said eyepiece.

* * * * *

UNITED STATES PATENT AND TRADEMARK OFFICE

CERTIFICATE OF CORRECTION

PATENT NO. : 5,463,495

DATED : October 31, 1995

INVENTOR(S) : Erwin Murg

It is certified that error appears in the above-identified patent and that said Letters Patent is hereby corrected as shown below:

Col. 2, line 29, after "description" insert --and from the claims--.

Col. 3, claim 1, line 24, "maid" should be --main--.

Col. 4, claim 3, line 12, "Center" should be --center--.

Signed and Sealed this

Twenty-fourth Day of September, 1996

Bruce Lehman

*Attest:*

BRUCE LEHMAN

*Attesting Officer*

*Commissioner of Patents and Trademarks*